US008511678B2

(12) United States Patent
Azuma et al.

(10) Patent No.: US 8,511,678 B2
(45) Date of Patent: Aug. 20, 2013

(54) SHEET STACKER AND IMAGE FORMING APPARATUS

(75) Inventors: Terumitsu Azuma, Aichi (JP); Shigefumi Soga, Aichi (JP); Takeshi Hirabayashi, Aichi (JP); Kentaro Fukami, Aichi (JP); Shinji Tanoue, Aichi (JP); Hiroki Yoshida, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 132 days.

(21) Appl. No.: 12/659,017

(22) Filed: Feb. 23, 2010

(65) Prior Publication Data

US 2010/0237556 A1 Sep. 23, 2010

(30) Foreign Application Priority Data

Mar. 18, 2009 (JP) ..... 2009-066748
Oct. 27, 2009 (JP) ..... 2009-246516

(51) Int. Cl.
*B65H 31/04* (2006.01)

(52) U.S. Cl.
USPC ..... 271/213; 271/218

(58) Field of Classification Search
USPC ..... 271/207, 213, 214, 215, 217, 218
See application file for complete search history.

(56) References Cited

U.S. PATENT DOCUMENTS 5,033,731 A * 7/1991 Looney ..... 271/176
5,350,169 A * 9/1994 Hiroi et al. ..... 271/213
5,497,984 A * 3/1996 Murakami et al. ..... 270/58.02
5,655,765 A 8/1997 Asami et al.
5,788,229 A 8/1998 Asami et al.
6,089,772 A * 7/2000 Takemura et al. ..... 400/625
6,145,825 A 11/2000 Kunihiro et al.
6,296,247 B1 10/2001 Tamura et al.
6,494,449 B2 12/2002 Tamura et al.
7,207,559 B2 * 4/2007 Mizuta et al. ..... 271/207
7,922,164 B2 * 4/2011 Nakayama ..... 270/58.12
7,954,801 B2 * 6/2011 Fukami ..... 270/58.11
2004/0195758 A1 * 10/2004 Cost ..... 271/177
2010/0019446 A1 * 1/2010 Matsumoto et al. ..... 271/302

FOREIGN PATENT DOCUMENTS

JP 2003-073009 3/2003
JP 2006-240761 9/2006
JP 2007-055722 3/2007
JP 4072515 1/2008
JP 2008-110834 5/2008

OTHER PUBLICATIONS

English language abstract of JP 2004-244225, Sep. 2, 2004.

* cited by examiner

*Primary Examiner* — Michael McCullough
(74) *Attorney, Agent, or Firm* — Harness, Dickey & Pierce, P.L.C.

(57) ABSTRACT

A sheet processing apparatus includes a fixed tray and a movable tray. The fixed tray is fixed at its downstream portion in a sheet transport direction and includes a sheet loading surface. A downstream portion of the sheet loading surface of the fixed tray is positioned at a higher level than an upstream portion thereof. The movable tray is pivotally supported, at its upstream portion, by a pivot support provided on the fixed tray. An angle between a sheet loading surface of the movable tray and a horizontal direction is more gentle than an angle between the sheet loading surface of the fixed tray and the horizontal direction.

15 Claims, 5 Drawing Sheets

SHEET STACKER AND IMAGE FORMING APPARATUS

CROSS-REFERENCE TO RELATED APPLICATIONS

The present application claims priority to and incorporates by reference the entire contents of Japanese Patent Application No. 2009-066748 filed in Japan on Mar. 18, 2009 and Japanese Patent Application No. 2009-246516 filed in Japan on Oct. 27, 2009.

BACKGROUND OF THE INVENTION

1. Field of the Invention

The present invention generally relates to a sheet stacker to stack an incoming sheet-type recording medium (hereinafter, "sheet"), and to an image forming apparatus, such as a copying machine, a printer, a facsimile, and a digital multifunction product, that includes the sheet stacker.

2. Description of the Related Art

A sheet stack position, to which a sheet is delivered and at which the sheet is stacked, is set differently depending on a use and/or the configuration of an image forming apparatus or an image forming system. Under such a circumstance, techniques aiming at providing a sheet stacker to stack output sheets in a limited space while ensuring a certain stack capacity have been disclosed. Known examples of the techniques include a technique disclosed in Japanese Patent Application No. 2008-110834, according to which a sheet stack position is located both above and below an image forming apparatus. According to the technique disclosed in Japanese Patent Application No. 2008-110834, the image forming apparatus includes an image forming unit that forms an image on a recording medium sheet, and an output unit that outputs the recording medium sheet to an internal sheet-output unit that includes a sheet output tray. The sheet output tray includes a loading surface, on which the recording medium sheet output from the output unit is to be stacked, and an angle-adjusting unit capable of changing an angle of the loading surface of the sheet output tray on a side close to the output unit relative to an output direction, in which the recording medium sheet is output from the output unit.

Examples of techniques for configuring an entire tray to be ascendible and descendible by using a motor are disclosed in Japanese Patent No. 4072515, Japanese Patent Application No. 2007-055722, Japanese Patent Application No. 2003-073009, and Japanese Patent Application No. 2006-240761. According to a technique disclosed in Japanese Patent No. 4072515 among these examples, an image forming apparatus includes an image forming unit that forms an image according to image data on a recording sheet being conveyed, a reading device that is arranged above the image forming unit and scans an original to obtain image data, a sheet stacker unit that is arranged in a space between the image forming unit and the reading device and that stacks an output sheet thereon, a sheet output unit that is arranged in a lateral direction of the space and that outputs a sheet to a sheet stacker unit. The image forming apparatus includes a drive unit that includes a motor that causes the stacker unit to ascend and descend. A sheet loading surface of the stacker unit is tilted such that a downstream portion of a batch transport unit in a transport direction is positioned higher, and the motor is arranged at a position that is below the sheet loading surface of the stacker unit and downstream relative to the batch transport unit.

Techniques for configuring an entire sheet output tray to be ascendible and descendible are disclosed in Japanese Patent Application No. 2007-055722, Japanese Patent Application No. 2003-073009, and Japanese Patent Application No. 2006-240761 as well.

Each of these techniques aims at increasing efficiency in loading output sheets by effectively utilizing a limited space; however, the technique disclosed in Japanese Patent Application No. 2008-110834 is disadvantageous in that because a fixed side of the sheet output tray extends substantially horizontally, if a highly-resilient sheet is placed on the sheet output tray, even when an angle of the loading surface of the sheet output tray is changed, the sheet can fail to follow the loading surface of which angle has been changed and block a sheet output port.

The techniques disclosed in Japanese Patent No. 4072515, Japanese Patent Application No. 2007-055722, Japanese Patent Application No. 2003-073009, and Japanese Patent Application No. 2006-240761 are also disadvantageous in requiring a large space below the image forming apparatus to allow the entire tray to move and requiring a space to allow a sheet located out of the apparatus to be out of the way of the tray because a position of a leading end of the sheet in a sheet transport direction varies depending on the orientation of the tray. These impose difficulty in achieving compact configuration and space saving.

SUMMARY OF THE INVENTION

It is an object of the present invention to at least partially solve the problems in the conventional technology.

According to an aspect of the present invention, there is provided a sheet stacker including a sheet output tray configured to receive a sheet and stack the sheet, the sheet output tray including a fixed tray and a movable tray, an upstream portion of the fixed tray with respect to a sheet transport direction being fixed, and an upstream portion of the movable tray being pivotably fixed at a pivot support arranged on the fixed tray, the fixed tray having a sheet loading surface, a downstream portion of the sheet loading surface being located at a higher level than an upstream portion of the sheet loading surface, an angle between a sheet loading surface of the movable tray and the sheet loading surface of the fixed tray is set to an obtuse angle in any one of a no-sheet-loaded state and a not-yet-fully-loaded state.

According to another aspect of the present invention, there is provided an image forming apparatus including the sheet stacker described above, wherein the sheet stacker is arranged at any one of a position in a body of the image forming apparatus and a position on the body, each of the positions being below an image reading apparatus that is mounted on the body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

1. Overall Configuration

Figure 1:
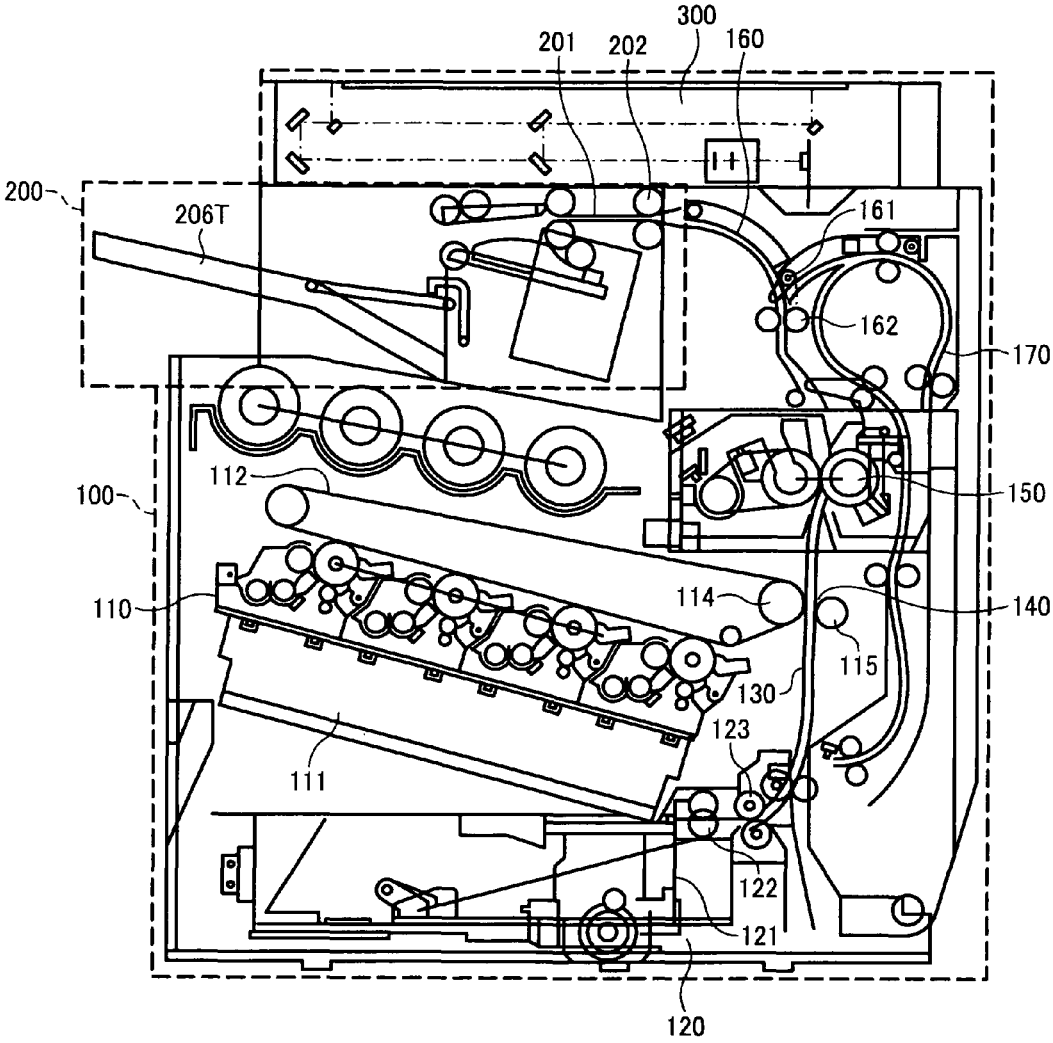
FIG. 1 is a schematic diagram illustrating a system configuration of an image forming system according to an embodiment of the present invention.

FIG. 1 is a schematic diagram illustrating a system configuration of an image forming system 1000 according to an embodiment of the present invention. The image forming system 1000 includes an image forming apparatus 100, a sheet processing apparatus 200, and an image reading apparatus 300.

The image forming apparatus 100 is a tandem color image forming apparatus of an indirect transfer type and includes an image forming unit 110 that includes image forming stations 111 for four colors depicted at a substantially center of FIG. 1, an optical writing unit arranged adjacent to and below the image forming unit 110, a sheet feed unit 120 arranged below the image forming unit 110, a sheet-feed transport path (vertical transport path) 130 for transporting a sheet picked up by the sheet feed unit 120 to an intermediate transfer unit 140 and to a fixing unit 150, a sheet-output transport path 160 that transports a sheet, onto which an image is fixed, to the sheet processing apparatus 200, and a duplex-print transport path 170 for turning a sheet, on one side of which an image is formed, upside down so that an image is formed on the other side.

The image forming unit 110 includes, in addition to photosensitive drums on an individual color basis of yellow (Y), magenta (M), cyan (C), and black (K) of the image forming stations 111, an electrostatic charging unit, a developing unit, a primary transfer unit, a cleaning unit, and an electrostatic discharging unit that are provided for each of the photosensitive drums and arranged around the perimeter thereof, an intermediate transfer belt 112, onto which one or more images formed on the photosensitive drums are primary-transferred by a primary transfer unit, and the optical writing unit that writes images to the photosensitive drums on a color-by-color basis. The optical writing unit is arranged below the image forming station 111. The intermediate transfer belt 112 is arranged above the image forming stations 111. The intermediate transfer belt 112 is configured to be rotatably supported by a plurality of support rollers, one of which is a support roller 114 that opposes a secondary transfer roller 115 at the intermediate transfer unit 140 with the intermediate transfer belt 112 therebetween, so as to perform secondary transfer of an image on the intermediate transfer belt 112 onto the sheet. Meanwhile, because image forming process implemented by a tandem color image forming apparatus of an indirect transfer type is known and not directly related to the scope of the present invention, detailed description is omitted.

The sheet feed unit 120 includes a sheet feed tray 121, pickup rollers 122, and sheet-feed transport rollers 123 and feeds a sheet picked up from the sheet feed tray 121 upward along the vertical transport path 130. The thus-fed sheet is subjected to image transfer performed by the secondary transfer unit 140 and fed to the fixing unit 150. The fixing unit 150 includes a fixing roller and a pressure roller. During the course where a sheet passes through a nip between the fixing roller and the pressure roller, the sheet receives heat and pressure, by which toner is fixed onto the sheet.

Downstream from the fixing unit 150, the transport path bifurcates into the sheet-output transport path 160 and the duplex-print transport path 170. Whether a sheet shall be transported to the sheet-output transport path 160 or to the duplex-print transport path 170 is decided by the position of a path-switching flap 161. When the sheet is transported to the sheet-output transport path 160, it is further conveyed to the sheet processing apparatus 200. Branch transport rollers 162 are arranged immediately upstream of the path-switching flap 161 in the sheet transport direction to exert conveying force on the sheet.

The sheet processing apparatus 200 is arranged inside the image forming apparatus 100. The sheet processing apparatus 200 performs predetermined processing on a sheet, on which an image has been formed and which is transported from the image forming apparatus 100. The sheet processed in the sheet processing apparatus 200 is stacked on the sheet output tray 206T positioned most downstream. The sheet processing apparatus 200 will be described in detail later.

The image reading apparatus 300 is of a known type that optically scans an original placed on an exposure glass to obtain an image of the original. Because the configuration and function of the image reading apparatus 300 per se are known and not directly related to the scope of the present invention, detailed description is omitted.

With the image forming apparatus 100 that is generally configured as mentioned above, image data for use in writing is generated based on data on an image obtained by scanning by the image reading apparatus 300 or print data transferred from an external personal computer (PC) or the like, optical writing on the photosensitive drums is performed by the optical writing unit based on the image data, and images formed by the image forming stations on a color-by-color basis are sequentially transferred onto the intermediate transfer belt 112. A full-color image is formed by superimposing the images of four colors on one another on the intermediate transfer belt 112. Simultaneously, a sheet is fed from the sheet feed tray 121 in response to the image forming operation. The sheet is temporarily stopped at a position of registration rollers (not shown) immediately upstream of the intermediate transfer unit 140, transported downstream from the position timed to a leading end of the image on the intermediate transfer belt 112, subjected to secondary transfer performed at the intermediate transfer unit 140, and fed to the fixing unit 150.

If the sheet, onto which the image is fixed by the fixing unit 150, has undergone single-sided printing or printing of both sides for both-sided printing, the path-switching flap 161 is switched so as to transport the sheet to the sheet-output transport path 160 while if the sheet is for both-sided printing, the path-switching flap 161 is switched so as to transport the sheet to the duplex-print transport path 170. The sheet transported to the duplex-print transport path 170 is turned upside down, again sent to the intermediate transfer unit 140 where an image is formed on the other side, and thereafter returned to the sheet-output transport path 160. The sheet transported to the sheet-output transport path 160 is transported to the sheet processing apparatus 200. The sheet processing apparatus 200, after performing predetermined sheet processing on the sheet, or without performing any processing thereon, delivers the sheet onto the sheet output tray 206T.

2. Sheet Processing Apparatus

Figure 2:
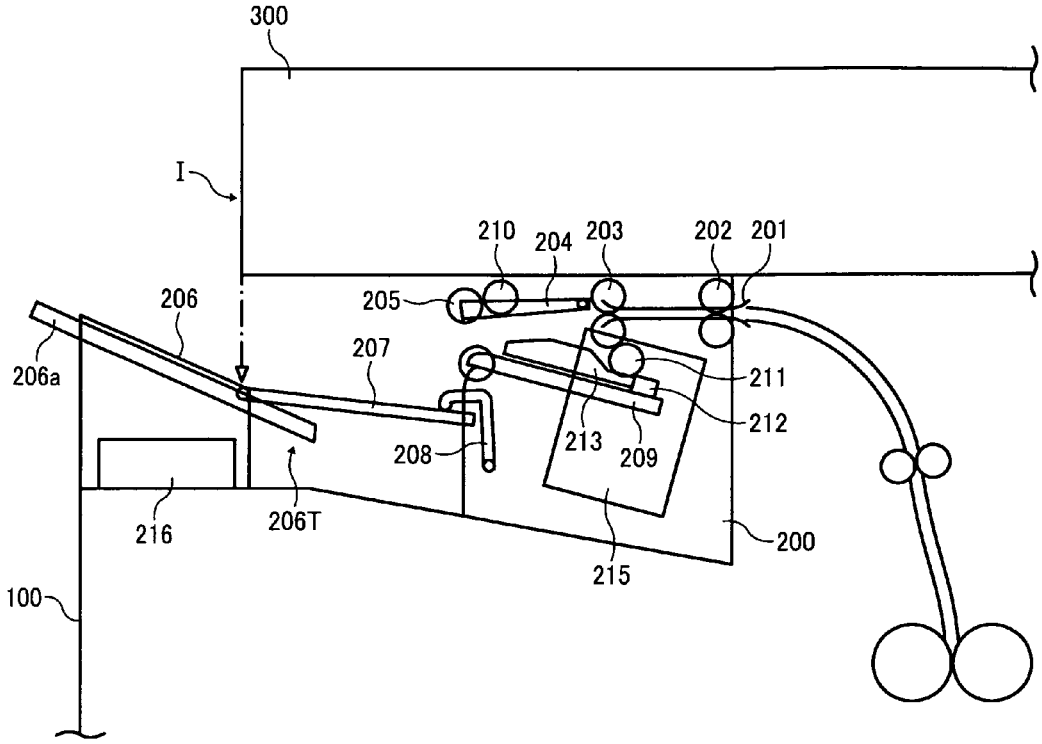
FIG. 2 is a front view schematically illustrating the configuration of a sheet processing apparatus.

FIG. 2 is a front view schematically illustrating the configuration of the sheet processing apparatus 200.

Referring to FIG. 2, the sheet processing apparatus 200 includes a pair of entrance rollers 202, a trailing-end reference fence 212, a jogger fence 213, a stapler 215, sheet-delivery-for-stapling rollers 203, a tapping roller 210, sheet output rollers 205, a sheet-trailing-end retainer 208, a sheet-output-tray movable unit 207, and the sheet output tray 206T that are arranged along the sheet transport direction in this order. The sheet processing apparatus 200 further includes a guide plate 201, a for-stapling-sheet tray 209, a trailing-end return roller 211, and a sheet-output on/off guide plate 204. The sheet output tray 206T includes the sheet-output-tray fixed unit 206, the sheet-output-tray movable unit 207, and an auxiliary tray 206*a* that can be pulled out parallel to the sheet loading surface and is to be used when a large-sized sheet is stacked.

More specifically, the guide plate 201 that receives a sheet from the sheet-output transport path 160 of the image forming apparatus 100 is arranged at a sheet receiving portion of the sheet processing apparatus 200. The pair of entrance rollers 202 is arranged most upstream of the guide plate 201 in the sheet transport direction while the pair of sheet-delivery-for-stapling rollers 203 that has a function of shifting a sheet to thereby deliver the sheet onto the sheet output tray 206T is arranged most downstream of the guide plate 201. An entrance motor (not shown) is driven to rotate the pair of entrance rollers 202 and the pair of sheet-delivery-for-stapling rollers 203 so that the sheet is transported along the guide plate 201. The pair of entrance rollers 202 and the pair of sheet-delivery-for-stapling rollers 203 arranged along the guide plate 201 serve as transport means.

Because sheet delivery operation for a straight sheet-delivery mode and sheet delivery operation for a stapling mode of delivering a plurality of sheets after stapling the sheets together differ from each other, each of the modes and their configurations will be described below.

Straight Sheet-Delivery Mode

A sheet fed via the guide plate 201 is transported by the pair of entrance rollers 202 and the pair of sheet-delivery-for-stapling rollers 203 in this order, and delivered onto the sheet output tray 206T by the pair of sheet output rollers 205 that can pinch the sheet therebetween when the sheet-output on/off guide plate 204 is in closed position. Every time a few sheets have been delivered, the sheet-output-tray movable unit 207 is temporarily lowered; and, when a trailing end of a sheet passes through the pair of sheet output rollers 205, a rear end portion of the sheet-output-tray movable unit 207 is pressed by the sheet-trailing-end retainer 208 having been retreated to a position out of the way of sheet delivery, which moves the sheet-output-tray movable unit 207 upward. The sheet-trailing-end retainer 208 operates on an individual sheet basis. Although not illustrated, the sheet-trailing-end retainer 208 detects a height of a sheet stack.

Stapling Sheet-Delivery Mode

A sheet fed via the guide plate 201 is transported by the pair of entrance rollers 202 and the pair of sheet-delivery-for-stapling rollers 203 in this order so that the sheet falls onto the for-stapling-sheet tray 209. Thereafter, the tapping roller 210 is operated to work together with the trailing-end return roller 211 to bring a trailing end of the sheet into contact with the trailing-end reference fence 212, thereby performing vertical alignment (alignment in the transport direction). The jogger fence 213 performs lateral alignment (alignment in the direction orthogonal to the transport direction).

The operation is repeated in a similar manner until a last sheet has been stacked. When the last sheet has been stacked, the stapler 215 performs stapling, the sheet-output on/off guide plate 204 is set in the closed position, and the pair of sheet output rollers 205 delivers the thus-stapled sheet batch onto the sheet output tray 206T. When the sheet batch is delivered, the sheet-output-tray movable unit 207 is temporarily lowered; and, when the sheet batch passes through the pair of sheet output rollers 205, the rear end portion of the sheet-output-tray movable unit 207 is pressed by the sheet-trailing-end retainer 208 having been retreated to the position out of the way of sheet delivery, which moves the sheet-output-tray movable unit 207 upward.

The sheet-output-tray fixed unit 206 pivotally supports the sheet-output-tray movable unit 207. A portion, on the side of a sheet trailing end, of the sheet-output-tray movable unit 207 is moved up and down depending on the number of stacked sheets.

Figure 5:
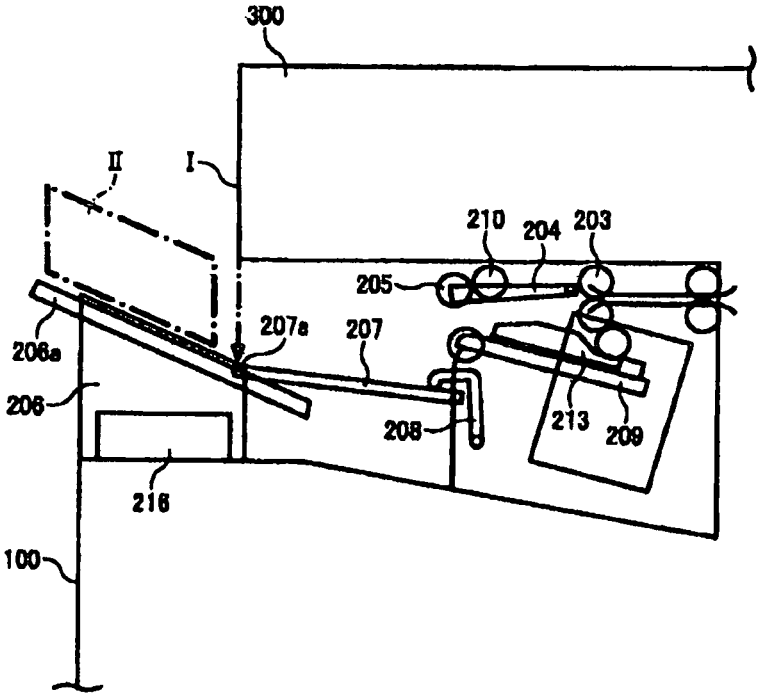
FIG. 5 is a schematic diagram for explaining how the sheet output tray looks.

As illustrated in FIG. 5, a pivot support 207*a* of the sheet-output-tray movable unit 207 is arranged substantially vertically below an end surface I of the image reading apparatus 300 positioned on the downstream side in the sheet transport direction (put another way, the side of a sheet leading end).

As illustrated in FIG. 5, arranging the pivot support 207*a* substantially vertically below the end surface I causes sheets to be stacked in an invariant sheet stack state without fail on the sheet-output-tray fixed unit 206 that is fixed in an area II, which is an area where a user can easily view the sheet stack state on the sheet-output-tray fixed unit 206. This allows a user to determine how many sheets are stacked on the sheet-output-tray fixed unit 206 easily.

Figure 3:
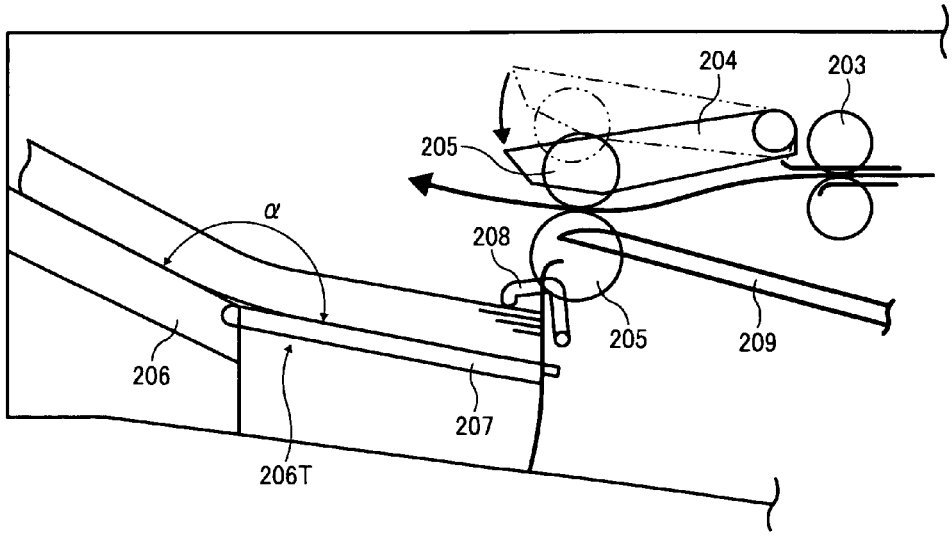
FIG. 3 is a schematic diagram illustrating a sheet output tray on which a small number of sheets are loaded.
Figure 4:
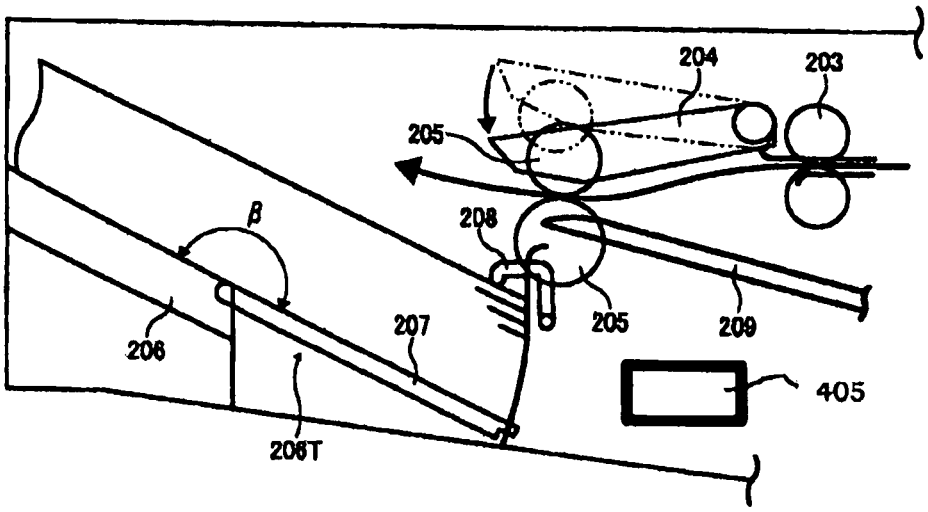
FIG. 4 is a schematic diagram illustrating the sheet output tray in a fully-loaded state.

An angle $\alpha$ between the sheet-output-tray fixed unit 206 and the sheet-output-tray movable unit 207 is set to an obtuse angle in a no-load state and a not-yet-fully-loaded state as illustrated in FIG. 3. As shown in FIG. 4, when an angle $\beta$ between the sheet-output-tray fixed unit 206 and the sheet-output-tray movable unit 207, of which free-end side descends by a distance that depends on an amount of stacked sheet, reaches approximately 180 degrees and the sheet-output-tray 206 and the sheet-output-tray movable unit 207 form a substantially flat surface, a detecting unit 405 detects that the tray is full. Any generally-used detector, such as a transmission-type photodetector or a reflection-type photodetector, can be used as the detecting unit.

If an initial value of the angle between the sheet-output-tray fixed unit 206 and the sheet-output-tray movable unit 207 is set to a reflex angle $\beta'$ (180 degrees to 360 degrees), it is possible that a highly-resilient sheet and a considerably-curled sheet conforms to an angle of the sheet-output-tray fixed unit 206, causing a trailing end of the sheet to fail to follow movement of the sheet-output-tray movable unit 207 even when the sheet-output-tray movable unit 207 pivots. If a trailing end of a sheet fails to follow in this manner, stack quality can degrade. However, in the present embodiment, because an initial value of the angle $\alpha$ is set to an obtuse angle, a sheet follows movement of the sheet-output-tray movable unit 207. This prevents degradation in stack quality.

Figure 6:
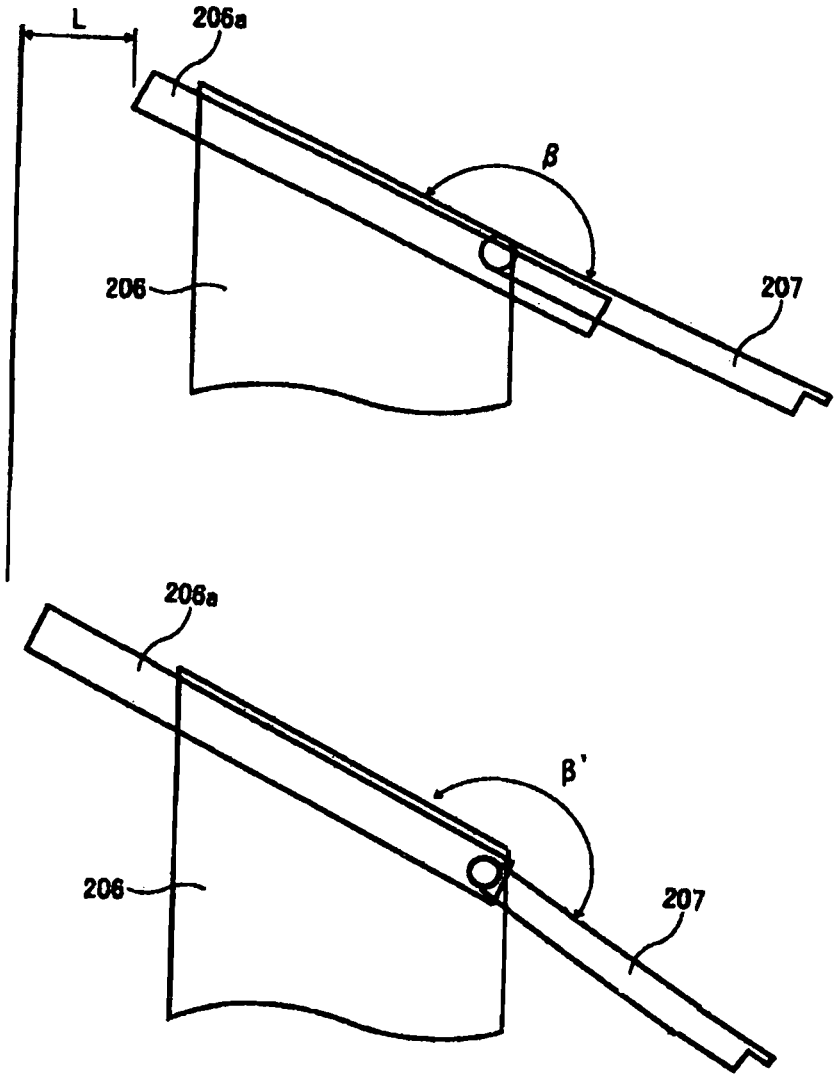
FIG. 6 is a schematic diagram for explaining a mount angle of the sheet output tray.

As illustrated in FIG. 6, an interior space of the sheet output tray in a fully-loaded state is limited, which significantly inhibits housing operation of the auxiliary tray 206*a* that can be pulled out and is to be used when a large-sized sheet is stacked. This prevents the apparatus from becoming less compact.

The angle of the sheet-output-tray fixed unit 206 relative to the horizontal direction is desirably in a range from 20 degrees to 35 degrees. The initial value of the angle $\alpha$ is desirably in a range from 140 degrees to 160 degrees.

The sheet processing apparatus 200 is provided independently of the circuit board of image forming apparatus 100 in many cases. Such a configuration, in which a circuit board 216 is incorporated in the image forming apparatus 100, requires an additional job of detaching the sheet processing apparatus 200 to perform maintenance. In addition, there arises a concern that receiving a relatively large influence from internal temperature of the fixing unit 150 and the like can result in early degradation.

Figure 7:
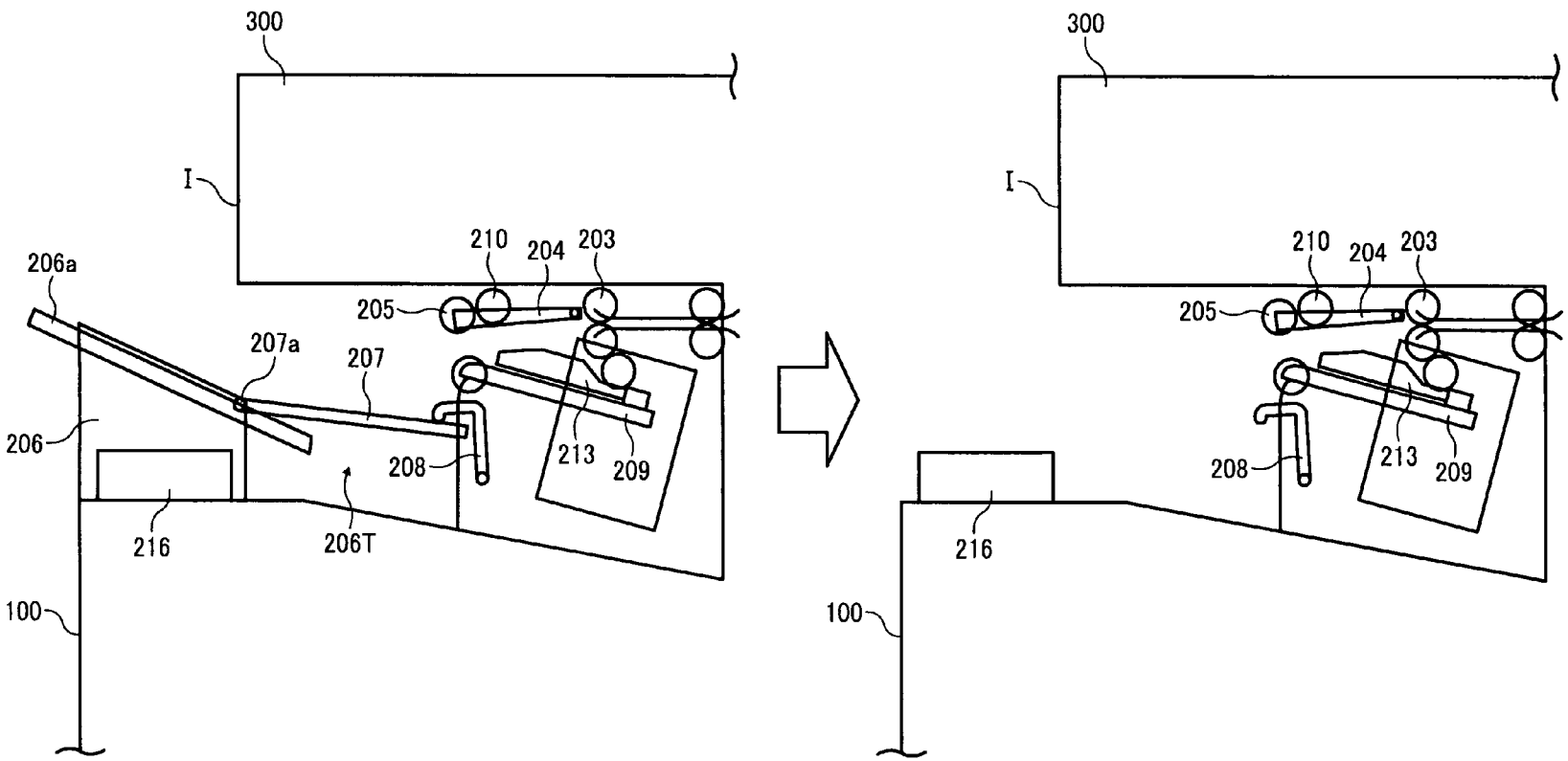
FIG. 7 is a schematic diagram illustrating an example, in which a circuit board is arranged below the sheet output tray.

To eliminate such a concern, in the present embodiment, the circuit board 216 is arranged below the sheet-output-tray fixed unit 206. Configuring the sheet output tray 206T into a fixed tray makes this arrangement feasible. If the sheet-output-tray fixed unit 206 is configured into a movable tray, wiring or the like that is connected to the circuit board 216 via a connector can come into contact with the sheet-output-tray fixed unit 206, causing a failure to occur. The circuit board 216 can be mounted topside down so as not to come into contact with the wiring of the sheet-output-tray fixed unit 206; however, maintenance of the circuit board 216 mounted in such a manner is to be performed by accessing the circuit board 216 from below, which involves detachment of the sheet processing apparatus 200 from the image forming apparatus 100 as illustrated in FIG. 7. This makes maintenance disadvantageously time-and-work consuming.

However, because the sheet-output-tray fixed unit 206 is fixed, occurrence of such a disadvantage is prevented.

As discussed above, the present embodiment can provide the following advantages.

1) Arranging a fixed tray located downstream in a transport direction so as to have a more gentle angle than an angle of a movable tray located upstream in the transport direction allows a trailing end of a stacked sheet to follow the movable tray. Accordingly, a stack state is held in an ideal condition.

2) Because the stack state is held as discussed in 1), a highly-reliable sheet stacker, of which stack state is stabled in a limited space, is provided.

3) Setting the angle of the fixed tray to be substantially equal to that in a fully-loaded-with-sheet state makes it possible to house a pull-out tray, which is housed in the fixed tray, also to a location below the movable tray without causing the pull-out tray to interfere with the movable tray.

4) Because the pull-out portion is allowed to be housed as discussed in 3), projection of the pull-out portion can be minimized, leading to efficient stacking of sheets in a limited space.

5) Because a circuit board is arranged in a space, around which the number of obstacles is relatively small, that has a predetermined size and is located most downstream in the transport direction immediately below the fixed tray and favorable in terms of environment far from a thermal source, both influence on wiring fixed to the circuit board and thermal influence on the circuit board are reduced. Accordingly, reliability can be increased.

6) Access to the circuit board is facilitated, which leads to provision of an apparatus that is highly durable and of favorable maintainability in a limited space.

It should be understood that the present invention is not limited to the above described embodiments, and it is intended to cover in the appended claims all various modifications as fall within the sprint and scope of the invention.

In the embodiments, the image forming apparatus is designated by reference numeral 100, the sheet processing apparatus is designated by reference numeral 200, the image reading apparatus is designated by reference numeral 300, the sheet stacker corresponds to a sheet-output-tray fixed unit 206 and a sheet-output-tray movable unit 207, the fixed tray corresponds to the sheet-output-tray fixed unit 206, the movable tray corresponds to the sheet-output-tray movable unit 207, the pivot support is designated by reference numeral 207*a*, the auxiliary tray is designated by reference numeral 206*a*, and the circuit board is designated by reference numeral 216.

According to an aspect of the present invention, it is possible to ensure, when sheet is to be output in a limited space, stable sheet output operation and stack state, thereby increasing reliability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising an image reading apparatus, an image forming unit that is arranged below the image reading apparatus, and a sheet stacker that is arranged between the image reading apparatus and the image forming unit, wherein the sheet stacker comprises:

a sheet output tray configured to receive a sheet and stack the sheet, the sheet output tray including a non-movable tray and a movable tray, the non-movable tray being disposed downstream of the movable tray; and a downstream portion of the movable tray being pivotably fixed at a pivot support arranged on the non-movable tray;

the non-movable tray having a sheet loading surface, a downstream portion of the sheet loading surface being located at a higher level than an upstream portion of the sheet loading surface, an angle between a sheet loading surface of the movable tray and the sheet loading surface of the non-movable tray is set to an obtuse angle in a non-sheet-loading state.

2. The image forming apparatus according to claim 1, wherein the pivot support of the movable tray of the sheet stacker is arranged substantially vertically below an end surface of the image reading apparatus, the end surface being positioned on a downstream side in the sheet transport direction.

3. The image forming apparatus according to claim 1, wherein the movable tray is configured to be pressed by a sheet trailing-end retainer.

4. The image forming apparatus according to claim 3, wherein the sheet trailing-end retainer is configured to press the movable tray on an individual sheet basis.

5. The image forming apparatus according to claim 3, wherein the sheet trailing-end retainer detects a height of a sheet stack.

6. The image forming apparatus according to claim 1, further comprising a detecting unit, wherein the detecting unit detects when the non-movable tray is in the fully-loaded-with-sheet state.

7. The image forming apparatus according to claim 1, wherein an upstream portion of the non-movable tray is fixed relative to all directions orthogonal to a sheet transport direction.

8. The image forming apparatus according to claim 1, wherein the angle measure of the obtuse angle is between about 140 degrees and 180 degrees.

9. The image forming apparatus according to claim 1, wherein an angle between the non-movable tray and the horizontal direction is between about 20 degrees and 35 degrees.

10. The image forming apparatus according to claim 1, wherein an upstream end portion of the movable tray is configured to be a free end, and the movable tray is configured to descend by a distance that depends on an amount of stacked sheets such that the angle between the sheet loading surface of the movable tray and the sheet loading surface of the non-movable tray attains substantially 180 degrees in a fully-loaded-with-sheet state.

11. The image forming apparatus according to claim 1, wherein the non-movable tray includes an auxiliary tray that can be pulled downstream in the sheet transport direction parallel to the sheet loading surface of the non-movable tray.

12. The image forming apparatus according to claim 1, wherein a portion of the auxiliary tray is positioned below the movable tray when the auxiliary tray is to be housed in the non-movable tray.

13. The image forming apparatus according to claim 1, wherein a circuit board is arranged below the non-movable tray.

14. The image forming apparatus according to claim 13, wherein the circuit board is arranged with a connector-receiving surface of the circuit board facing upward.

15. The image forming apparatus according to claim 1, wherein the sheet is a high-resilient sheet or a considerably-curled sheet.

* * * * *